United States Patent [19]

Schäfer

[11] Patent Number: 4,955,490

[45] Date of Patent: Sep. 11, 1990

[54] SHELF SYSTEM, PARTICULARLY PALLET SHELF SYSTEM

[75] Inventor: Gerhard Schäfer, Neunkirchen-Salchendorf, Fed. Rep. of Germany

[73] Assignee: Fritz Schafer Gesellschaft mit beschränkter Haftung, Neunkirchen, Fed. Rep. of Germany

[21] Appl. No.: 139,012

[22] Filed: Dec. 29, 1987

[30] Foreign Application Priority Data

Dec. 30, 1986 [DE] Fed. Rep. of Germany ..... 3644692

[51] Int. Cl.[5] ..... A47B 47/00

[52] U.S. Cl. ..... 211/187; 211/189; 211/191

[58] Field of Search ..... 211/187, 189, 192, 190, 211/191

[56] References Cited

U.S. PATENT DOCUMENTS

| | | | |
|---|---|---|---|
| 2,895,619 | 7/1959 | Frazier | 211/187 X |
| 3,463,325 | 8/1969 | Zagotta et al. | 211/187 X |
| 3,545,626 | 12/1970 | Seiz | 211/187 X |
| 4,078,664 | 3/1978 | McConnell | 211/189 |
| 4,292,902 | 10/1981 | Barrineau | 211/153 |

*Primary Examiner*—Alvin C. Chin-Shue
*Assistant Examiner*—Sarah A. Lechok
*Attorney, Agent, or Firm*—Toren, McGeady & Associates

[57] ABSTRACT

A shelf system, particularly a pallet shelf system, includes longitudinal girders and/or transverse girders as support elements suspended from and/or fastened to upright posts. The longitudinal girders and/or transverse girders are sectional rails. The shelf system includes auxiliary or additional girders extending parallel to the longitudinal directions of the longitudinal girders and/or transverse girders. The auxiliary or additional girders are hooked and/or otherwise releaseably fashioned to the longitudinal girders and/or transverse girders. Each auxiliary additional girder has at least one sectional portion which laterally projects from the longitudinal girder and/or transverse girder. The at least one laterally projecting portion defines a support bracket for auxiliary support elements and/or guide elements of the shelf system, such as, crossbeams, yokes, shelf boards, separating rods, separating walls or the like.

19 Claims, 4 Drawing Sheets

FIG. 11
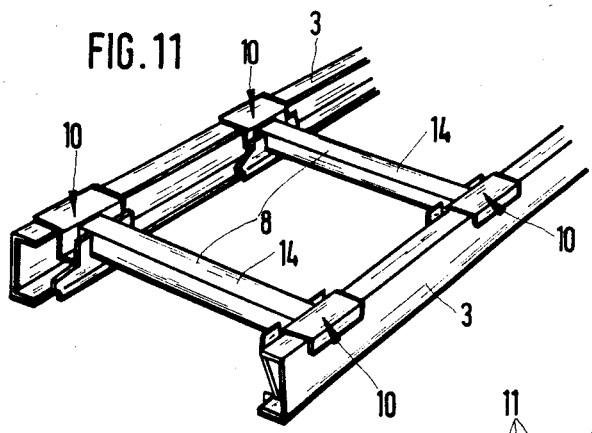
FIG. 12
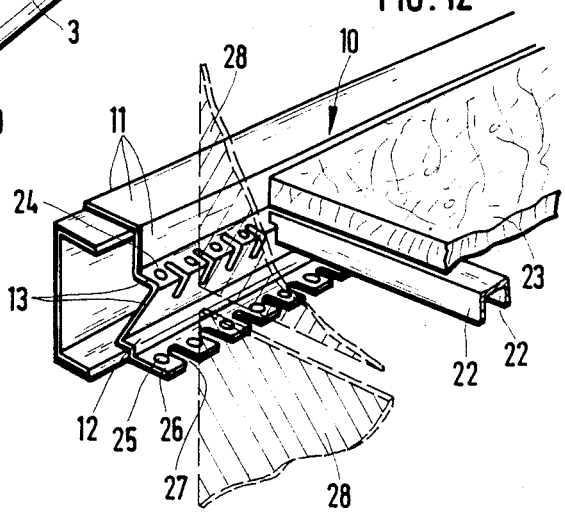
FIG. 13
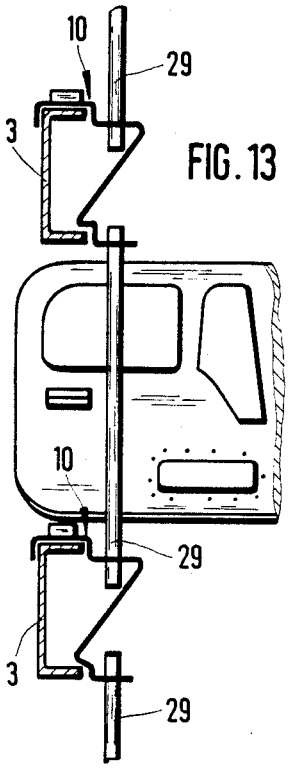
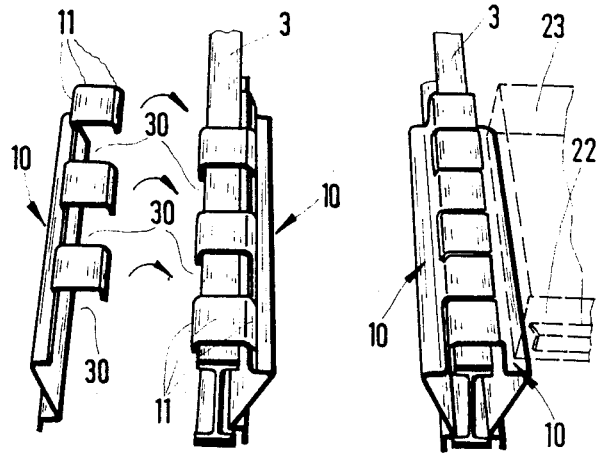
FIG. 14

SHELF SYSTEM, PARTICULARLY PALLET SHELF SYSTEM

BACKGROUND OF THE INVENTION

1. Field of the Invention

The present invention relates to a shelf system, particularly a pallet shelf system, having longitudinal girders and/or transverse girders as support elements suspended from and/or fastened to upright posts, wherein the longitudinal girders and/or transverse girders are sectional rails.

2. Description of the Prior Art

Shelf systems of the above-described type have been known for a long time and are used predominantly as so-called pallet shelf systems exclusively composed of the structural components described above.

The products or goods to be stored in a pallet shelf system of the above-described type are placed on standardized pallets which are placed by means of stacking devices on the longitudinal girders and/or transverse girders. The standardized pallets can then also be lifted from these girders.

However, in many cases, it is desirable or even required that the shelf system can receive goods which are not placed on pallets but which are to be introduced directly. The simultaneous storage of goods placed on pallets and of individual goods is frequently required in storage facilities for spare parts or replacement parts such as, motor vehicle parts which may include bulky components.

When bulky structural components are to be individually stored in the shelf system, it is necessary to provide shelf members in the shelf system, such as, gridirons, steel sheets or chipboards, which are placed on the longitudinal girders and/or transverse girders. In addition, these shelf members have to be secured to the girders to prevent the shelf members from sliding.

When shelf systems of the above-described type are equipped with such shelf members, there is the disadvantage that the placement of the shelf members on the longitudinal girders and/or transverse girders constructed as support elements requires a certain amount of space which is then effectively lost for the storage of goods. If, on the other hand, this loss of storage space is to be avoided, the setting up of the shelf members requires a substantial amount of special operations when the shelf system is erected. These special operations not only increase the expenses of the shelf system, but they also make it more difficult or even impossible to adapt the shelf system to changing storage requirements.

It is, therefore, the primary object of the present invention to provide a shelf system of the above-described type which avoids the disadvantages mentioned above. Specifically, it is the object of the present invention to provide a shelf system of the above-described type in which the longitudinal girders and/or transverse girders suspended from and/or fastened to the posts of the shelf system can be used at any time individually and directly as support elements for the pallets to be placed in the shelf system, while the girders can additionally be equipped with or completed to form closed shelf members without problems and requiring only a few manipulations.

SUMMARY OF THE INVENTION

In accordance with the present invention, the shelf system described above includes auxiliary or additional girders extending parallel to the longitudinal directions of the longitudinal girders and/or transverse girders, the auxiliary or additional girders being hooked and/or otherwise releasably fastened to the longitudinal girders and/or transverse girders. Each auxiliary or additional girder has at least one sectional portion which laterally projects from the longitudinal girder and/or transverse girder. The at least one laterally projecting portion defines a support bracket for auxiliary support elements and/or guide elements of the shelf system, such as, crossbeams, yokes, shelf boards, separating rods, separating walls or the like.

The shelf system according to the present invention has the advantage that the support brackets on the auxiliary or additional girders can be mounted without problems in such a way that the auxiliary support elements can be accommodated within the clear height of the longitudinal girders and/or transverse girders. Accordingly, when the auxiliary support elements are mounted in the shelf system, the available height of the storage space is not at all reduced.

In accordance with a feature of the present invention, each auxiliary or additional girder is a sectional member of laminated material, particularly a sheet metal section. Each auxiliary or additional girder has an upper hooking or clamping portion and a lower support or abutment portion. The sectional portion forming the support bracket is provided between the hooking or clamping portion and the support or abutment portion.

The stability of the shelf system is increased if, in accordance with another feature of the present invention, the hooking or clamping portion surrounds in a positively locking manner over its entire width the upper sectional portion of the longitudinal girders and/or transverse girders, while the support or abutment portion is frictionally fixed or secured in or on the lower sectional portion of the longitudinal girders and/or transverse girders.

In accordance with another feature, the support bracket of the auxiliary or additional girder is offset relative to the hooking or clamping portion thereof by the structural height of the auxiliary support elements. In addition, the support bracket may have engagement openings, such as, slots, teeth, grooves, holes or the like, which are adapted to correspond to the structural height of the auxiliary support elements.

The support bracket of the auxiliary or additional girder may have the shape of a channel, wherein the outer wall of the channel is provided with the engagement openings. For increasing the stability, the material of the outer wall of the channel may be doubled. On the other hand, the support bracket may also have an essentially triangular shape with an at least approximately horizontally extending web and an inclined web connected to and forming an acute angle with the horizontal web. The engagement openings may be provided in both webs.

Of course, it is also possible in accordance with the present invention to provide the auxiliary or additional girders in such a way that, after they have been releasably fastened to the longitudinal girders and/or transverse girders, they can be made effective with support brackets located on both sides of the longitudinal boundary of the girders.

However, in accordance with a preferred embodiment of the invention, the hooking or clamping portion of the auxiliary or additional girder is cut out or interrupted in longitudinal direction to form teeth, wherein the width of the gaps between the teeth is greater than the width of the teeth by a slight engagement play. Auxiliary or additional girders with such teeth can be mounted individually or in pairs on the same longitudinal girder and/or transverse girder. Accordingly, the system can be adapted to different requirements without problems.

In accordance with another possible further development of the present invention, the hooking or clamping portion of the auxiliary or additional girders has two end portions which face away from each other. One of the end portions extends uninterrupted over the entire length of the auxiliary or additional girder, while the other end portion is formed by lugs or tongues cut out and angularly bent from the auxiliary or additional girder. It has been found to be useful if the lugs or tongues are directed downwardly, while the uninterrupted end portion is directed upwardly.

In many cases it may be advantageous if the support bracket of the auxiliary or additional girder is formed at least partially by the support or abutment portion thereof or extends to the level of the support or abutment portion.

In accordance with another embodiment of the present invention, the support or abutment portions of the auxiliary or additional girders include clamping or locking pieces which engage in and are locked against rotation in engagement openings of the longitudinal girders and/or transverse girders.

The longitudinal girders and/or transverse girders may be L-sections, C-sections, G-sections or U-sections. The girders may be formed by bending laminated material, for example, sheet metal. However, it is also possible to use as the longitudinal girders and/or transverse girders T-sections or I-sections which are produced by rolling or extrusion of metal.

It is an important aspect of the present invention that the sections used as auxiliary or additional girders are coupled to the longitudinal girders and/or transverse girders by means of suspension connections which can be easily separated but are of high load-bearing capacity. In addition, when appropriately mounted in the shelf system, the auxiliary or additional girders practically only require a space which is the same as the structural height of the longitudinal girders and/or transverse girders.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

BRIEF DESCRIPTION OF THE DRAWING

In the drawing:

FIG. 11 is a perspective view, as in FIG. 2, of another embodiment of the invention;

FIG. 12 is a partial perspective view of a further development of, the embodiment illustrated in FIGS. 7 and 8;

FIG. 13 is a partial sectional view of a shelf system using the development of FIG. 12;

FIG. 14 is a perspective view of another further development of embodiment shown in FIGS. 7 and 8.

DETAILED DESCRIPTION OF THE INVENTION

Figure 1:
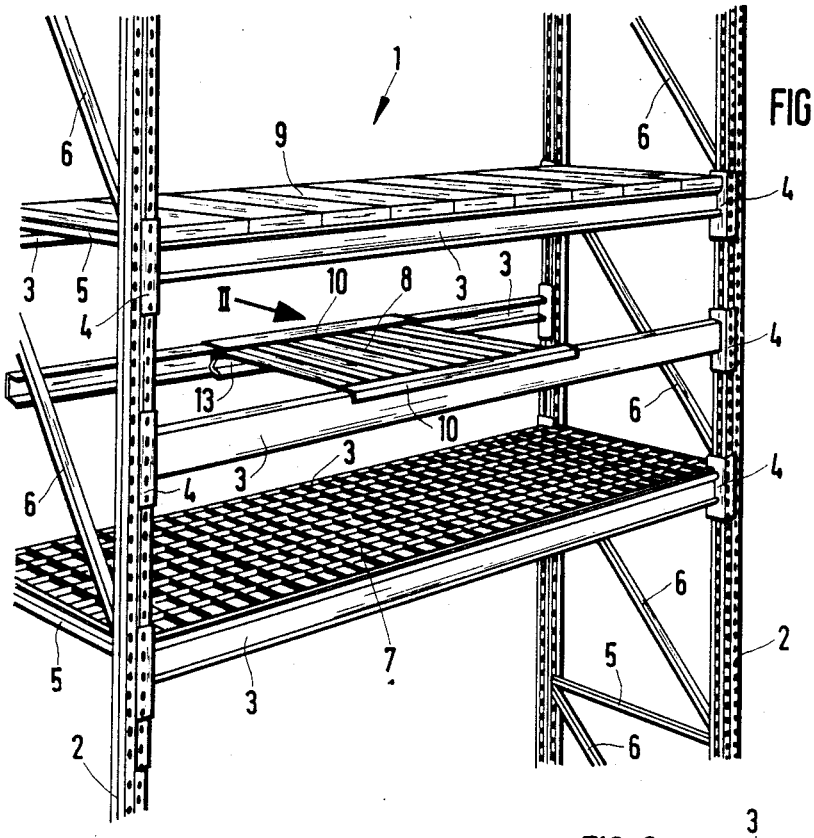
FIG. 1 is a partial perspective view of a shelf system according to the present invention, wherein the stacking planes are essentially formed by longitudinal girders on which additional shelf members are placed.

FIG. 1 of the drawing shows a shelf system 1 which includes four upright posts 2, however, only three of the upright posts 2 are seen in FIG. 1. Horizontally extending longitudinal girders 3 are releasably, but in a positively locking manner, connected between two posts 2 by means of coupling pieces attached to the ends of the girders.

The posts 2 which are located spaced apart one behind the otner are connected to each other by means of transverse girders 5 and inclined struts 6 to form the actual shelf system and/or to stabilize the shelf system.

In the shelf system illustrated in FIG. 1, the longitudinal girders 3 form the actual support elements for the shelf structure which receive the loads to be stored.

Longitudinal girders 3 may be sections formed by bending from laminated material, for example, sheet metal. In accordance with different uses, the longitudinal girder 3 may be L-shaped, C-shaped, G-shaped or U-shaped in cross-section.

However, similar cross-sectional shapes are also possible, for example, provided with additional corrugations, channels, webs or the like.

Of course, the longitudinal girders 3 may also be T-sections or I-sections manufactured by rolling or extrusion from metal.

If the transverse girders 5 are also used for load-bearing purposes, they may have the same sectional shape as the longitudinal girders 3. However, if the transverse girders 5 are only used together with the inclined struts 6 as spacers between the posts 2, they may have sectional shapes which are simple and particularly of lighter weight.

As can be seen in FIG. 1, it may be desirable in many cases to provide in the region of the longitudinal girders 3 more or less closed shelf members in the form of so-called auxiliary support elements Such shelf members are always required if not only goods resting on pallets are to be stored in the shelf system, but also individual components, for example, bulky motor vehicle parts. Such shelf members acting as auxiliary support elements may be, for example, gridirons 7, bar grates 8 or panel members, plate members or plank members 9. Metal sheets are also frequently used.

In order to ensure that the free space available in vertical direction between the shelf members acting as auxiliary support elements, such as, gridiron 7, bar grates 8 or plate members 9, is not significantly reduced, it is provided that these auxiliary support elements are almost completely mounted within the base defined by the cross-sectional height of the longitudinal girders 3.

Figure 2:
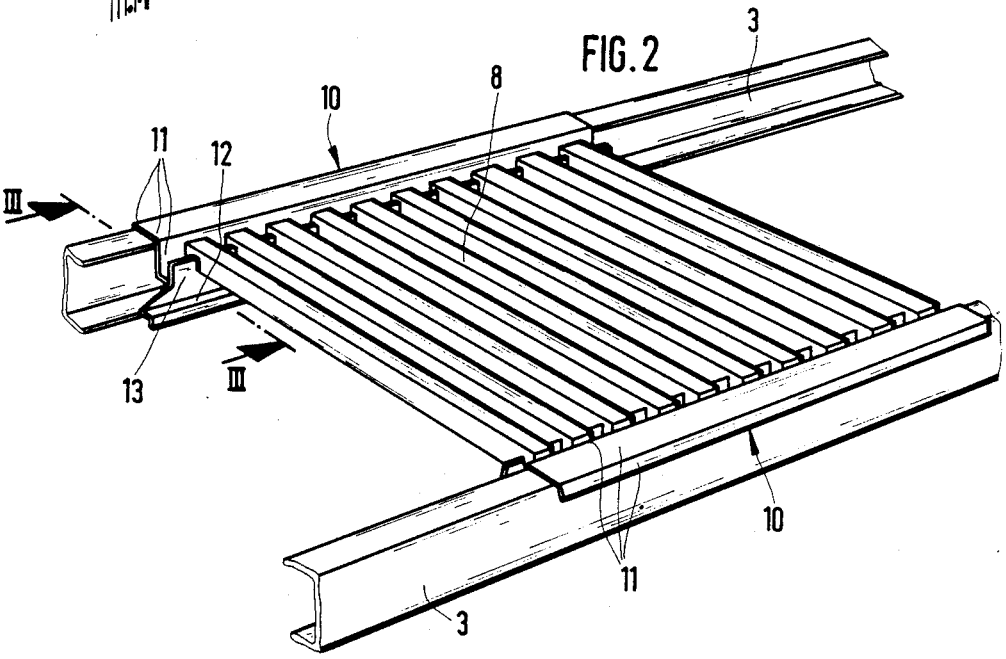
FIG. 2 is a perspective view, on a larger scale, of a detail indicated in FIG. 1 by arrow II.
Figure 3:
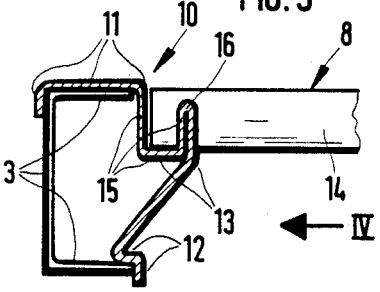
FIG. 3 is a sectional view, again on a larger scale, taken along sectional line III—III in FIG. 2.

To make this type of mounting of the auxiliary support elements possible, auxiliary or additional girders 10 are provided on the longitudinal girders extending parallel to the longitudinal direction of the longitudinal girders, as can be seen from FIGS. 1 and 2.

These auxiliary or additional girders 10 can be hooked and/or otherwise releasably fashioned in a simple manner to the longitudinal girders and/or transverse girders 10. Each of these auxiliary or additional girders 10 is advantageously made of a laminated material section, particularly a sheet metal section, and has an upper or hooking clamping portion 11 and a lower support or abutment portion 12.

In vertical direction between hooking or clamping portion 11 and the support or abutment portion 12, each auxiliary or additional girder 10 is provided with a laterally projecting sectional portion in the form of a support bracket 13. As illustrated in FIG. 2 with respect to the bar grate 8, support bracket 13 serves to support the auxiliary support elements 7, 8, 9.

FIGS. 3 to 10 show different embodiments of the auxiliary or additional girders 10. In each case, the auxiliary or additional girders 10 are constructed in such a way that the hooking or clamping portion 11 surrounds in a locking manner over its entire width the upper sectional portion of the longitudinal girder and/or transverse girder 3, as can be seen particularly clearly in FIGS. 3, 5, 7 and 9. The support or abutment portion 12 is fixed or secured in or on the lower sectional portion of the respective girder 3 as a result of the load from the auxiliary support elements 7, 8, 9 or the goods resting on the elements 7, 8, 9.

The support bracket 13 of each auxiliary or additional girder 10 is offset vertically relative to the hooking or clamping portion 11 by the structural height of the auxiliary support element, for example, the bar grate 8, as can be seen from FIGS. 3 to 6. In this case, the auxiliary or additional girders 10 become a significant component of the bar grate 8 because they act not only at support means but also as spacers between adjacent bars 14 of the bar grate 8.

The support bracket 13 of the auxiliary or additional girder 10 is for this purpose equipped with a channel section 15 with an outer longitudinal wall 16. As clearly shown in FIGS. 3 and 5, the longitudinal wall 16 may consist of two layers of material in order to obtain a stiffening of the bracket 13. Longitudinal wall 16 is provided with upwardly open recesses 17 extending over the entire height of the longitudinal wall 16. Recesses 17 are provided at predetermined distances from each other and form tooth-like wall portions 18. The tooth-like wall portions 18 are adapted in their shape to the outer contours of the bars 14.

Figure 4:
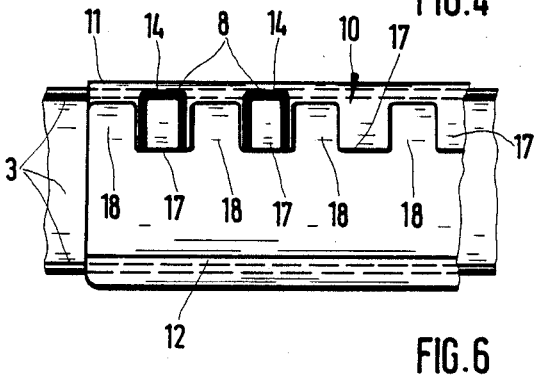
FIG. 4 is a side view seen in direction of arrow IV of FIG. 3.
Figure 5:
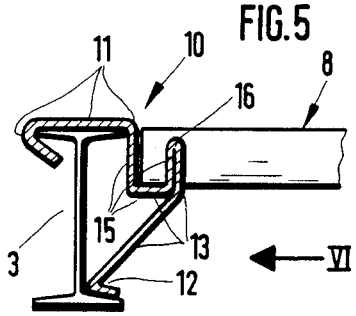
FIG. 5 is a sectional view, as in FIG. 3, of another embodiment of the shelf system.
Figure 6:
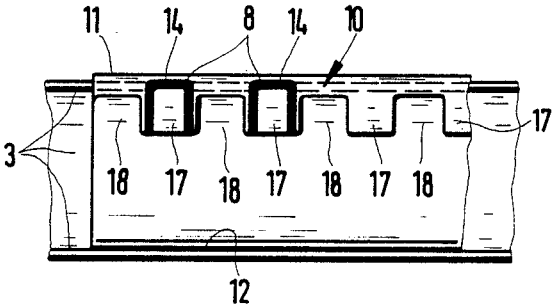
FIG. 6 is a side view in direction of arrow VI of FIG. 5.

As shown in FIGS. 4 and 6, the bar grate is formed by loosely placing the ends of the individual bars 14 into the recesses 17 of the longitudinal wall 16. Bars 14 are fixed relative to each other against sliding in transverse direction by the tooth-like wall portions 18. As clearly shown in FIGS. 3 and 5, the ends of the bars 14 are supported by the support bracket 13 within the channel section.

In the modified auxiliary or additional girders 10 illustrated in FIGS. 7 to 10, the support bracket 13 has an approximately triangular cross-section with an at least approximately horizontally extending web 19 and a downwardly inclined web 20 connected to webs 19 and forming an acute angle with webs 19. In this case, the recesses for the ends of the bars 14 of the bar grate 8 are slots 21 defined in both webs 19 and 20. Slots 21 support and hold downwardly directed flanges of U-shaped bars 14. The web of these bars 14 rests with its inner surface on the upper side of the horizontal web 19 of support bracket 19. Preferably, the web of bar 14 is in horizontal alignment with the horizontal portion of the hooking or clamping portion 11.

FIG. 11 of the drawing shows that it is also possible to provide for each individual bar 14 on both ends thereof an individual auxiliary or additional girder 10. These individual girders 10 may each be of the type described with respect to FIGS. 3 to 10.

As a result of this feature of the invention, an auxiliary or additional girder 10 must only be mounted on the girders 3 at those locations where actual bars 14 for forming a bar grate 8 are to be placed.

In the auxiliary or additional girders 10 shown in FIGS. 3 to 10, it is possible without problems to adjust the spacing between bars 14 of bar grates 8 to differing requirements by placing bars 14 into recesses 17 only at those locations where they are needed for the practical purpose.

Figure 7:
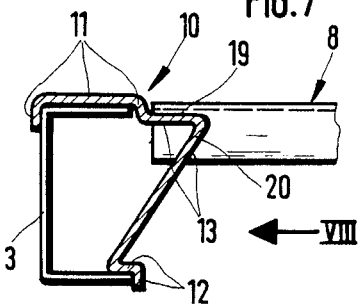
FIG. 7 is a sectional view, as in FIG. 3, of another embodiment of the shelf system.
Figure 8:
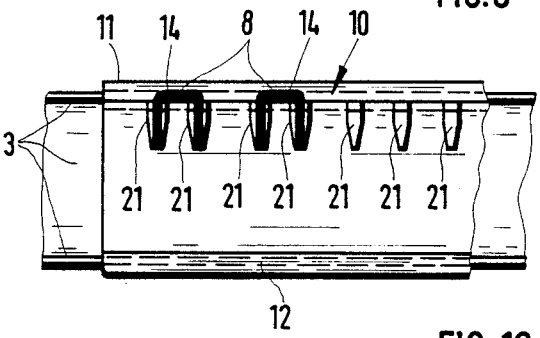
FIG. 8 is a side view in direction of arrow VIII of FIG. 5.

FIG. 12 of the drawing shows a modification of the auxiliary or additional girder 10 of FIGS. 7 and 8. In FIG. 12, the support bracket 13 is moved downwardly relative to the hooking or clamping portion 11, so that slots 21 defined in the bracket 13 are receiving the ends of bars 22 at a lower location. Bars 22 essentially correspond to bars 14. However, in this case, bars 22 are used for supporting panels or plates 21 which may form a panel or plate member 9 as it is shown in FIG. 1. However, contrary to the illustration of FIG. 1, the panels or plates 23 or FIG. 12 are mounted so that the upper sides thereof are essentially flush with the upper surface of the girders 3.

FIG. 12 further shows that holes 24 may be provided in the horizontal web 19 of bracket 13 of auxiliary or additional girder 10. FIG. 12 additionally shows that horizontal lugs or tongues 25 may project from the support or abutment portion 12 of auxiliary or additional girder 10. The lugs or tongues 25 may be provided with holes 26 which correspond to the holes 24 in webs 19. Recesses 27 are defined between the lugs or tongues 25. Recesses 27 are approximately in alignment with the slots 21 in brackets 13. Slots 21 in brackets 13 as well as recesses 27 between lugs or tongues 25 can be used as engagement means for vertically extending separating walls 28 for shelf compartments, as illustrated in FIG. 12.

Upright separating rods 29 can be inserted into the holes 24 of brackets 13 and the holes 26 of lugs or tongues 25, in order to create in the space between two girders 3 arranged on top of the other gaps for inserting bulky components, for example, motor vehicle doors and/or door linings.

FIG. 14 of the drawing shows that the individual auxiliary or additional girders 10 may also be suspended and fixed in pairs symmetrically on one girder 3 of the shelf system 1. For this purpose, the hooking or clamping portion 11 of each auxiliary or additional girder is cut out or interrupted, as designated by reference numeral 30, to form teeth, wherein the gaps between the teeth have a width which is greater than the width of the teeth by a slight engagement play, as can be seen from the lefthand portion of the exploded view of FIG. 14. In the assembled state of the two auxiliary or additional girders 10, the tooth-like portions of the hooking or clamping portions 11 of the two auxiliary or additional girders 10 engage alternatingly between the gaps 30, as can be seen in the righthand portion of FIG. 14.

Figure 9:
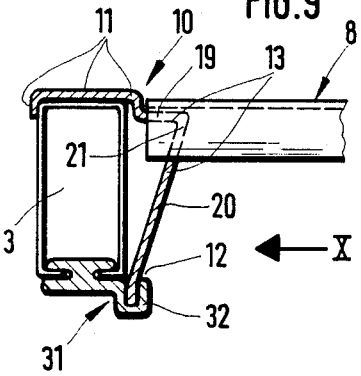
FIG. 9 is a sectional view, as in FIG. 3, of another embodiment of the shelf system.
Figure 10:
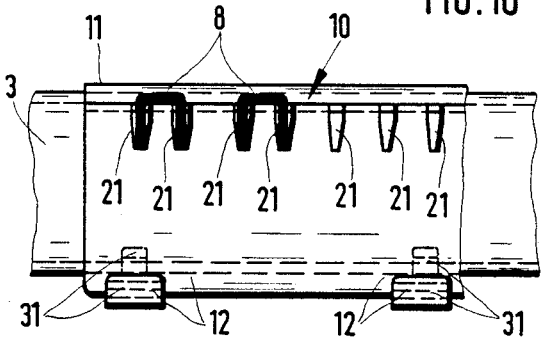
FIG. 10 is a side view in direction of arrow X of FIG. 5.
Figure 15:
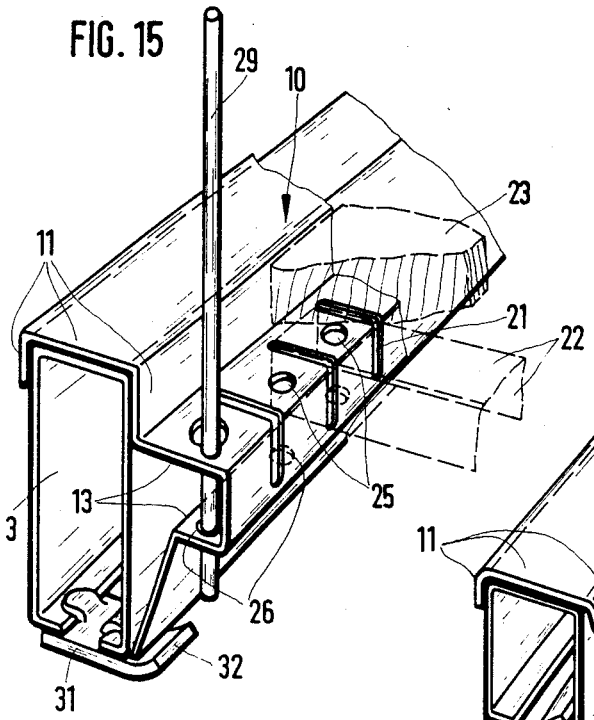
FIGS. 15 to 17 are partial perspective views of other embodiments of the shelf system according to the present invention.

FIGS. 9, 10 and 15 of the drawing show that, when the girders 3 have a downwardly open C-shaped section, the support or abutment portion 12 of auxiliary or additional girder 10 may interact with special clamping or locking pieces 31 which can be secured to the girders 3 with any selected spacing by rotational locking action. These clamping or locking pieces 31 have support jaws 32 which may interact with the support or abutment portions 12 of the auxiliary or additional girders 10.

Figure 16:
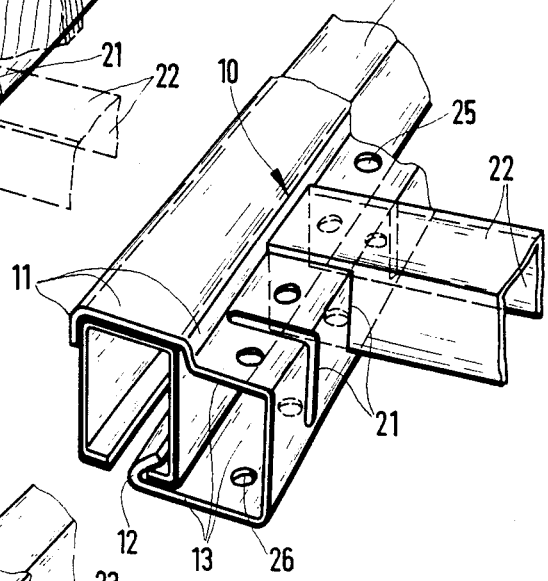

FIGS. 15 and 16 further show auxiliary or additional girders 10 which are modified versions of the those shown in FIGS. 12 and 13. The support bracket 13 shown in FIG. 15 not only holes 25 and 26 for the insertion of upright separating rods 29, but support bracket 13 further has slots 21 which receive rods 22 for supporting panels or plates 23. Bracket 13 shown in FIG. 15 has such a shape that panels or plates resting on bracket 13 and on bars 22 are approximately flush with the upper longitudinal edge of longitudinal girder 3.

FIG. 16 of the drawing shows that, if necessary, one of the transverse girders 5 shown in FIG. 1 may also be equipped with an auxiliary or additional girder 10. In this case, transverse girder 5 also has a downwardly open C-shaped cross-section whose top is engaged in a form-locking manner by the hooking or clamping portion 11 of auxiliary or additional girder 10. The support or abutment portion 12 of the auxiliary or additional girder 10 engages at the bottom in the longitudinal slot of transverse girder 5. Support bracket 13 is connected immediately to the support or abutment portion 12, while the bracket 13 is offset at the top relative to the hooking or clamping portion 1 to a certain extent that the bars 22 received in the slots 21 are located approximately flush with the upper edge of the transverse girder 5. Holes 25 and 26 of the auxiliary or additional girder 10 shown in FIG. 16 can also used for receiving vertically extending separating rods 29, similar to those shown in FIG. 15.

Figure 17:
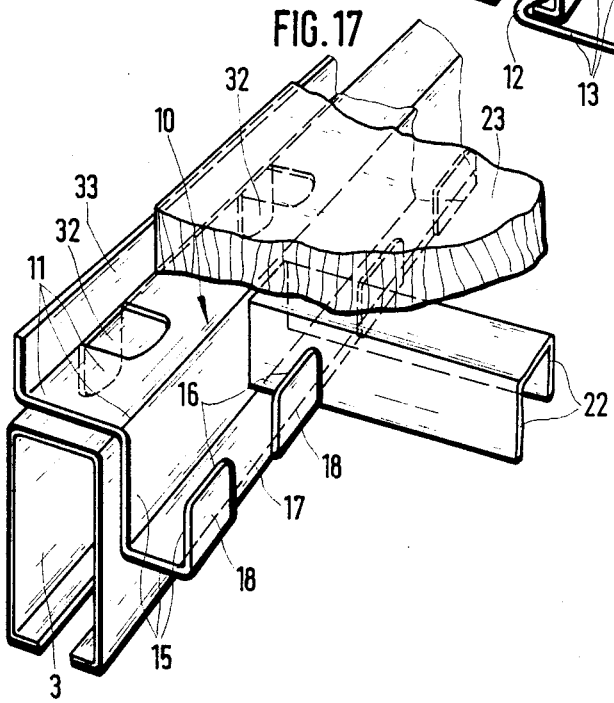

FIG. 17 of the drawing shows yet another embodiment of an auxiliary or additional girder 10 in which the outer side of the hooking or clamping portion 11 is defined by lugs or tongues 32 which are cut from the material of the horizontal web and are bent downwardly. An upwardly directed end portion 33 is located adjacent the hooking or clamping portion 11. The end portion 33 is located in the same plane as the lugs or tongues 32. End portion 33 acts as a lateral stop for the panels or plates 23 placed on auxiliary or additional girders 10. The panels or plates 23 are additionally supported by bars 22 which are fixed on the auxiliary or additional girder 10 in a similar manner as those shown in the embodiments of FIGS. 3 to 6. Specifically, the bars 22 are received in recesses 17 defined between tooth-like wall portions of an outer longitudinal wall 16 of a channel section 15.

While specific embodiments of the invention have been shown and described in detail to illustrate the application of the inventive principles, it will be understood that the invention may be embodied otherwise without departing from such principles.

I claim:

1. A shelf system comprising upright posts and longitudinal girders and transverse girders fastened between the upright posts, wherein at least the longitudinal girders are support elements and are suspended from the upright posts, and wherein at least the longitudinal girders are sectional rails, further comprising laterally projecting sectional portions each defining a support bracket for auxiliary support elements of the shelf system, wherein the auxiliary support elements are selected from the group consisting of crossbeams, yokes, shelf boards, separating rods and separating walls, the laterally projecting sectional portions each being part of auxiliary or additional girders, the auxiliary or additional girders extending parallel to the longitudinal direction of the longitudinal girders and being releasably hooked to the longitudinal girders, the auxiliary or additional girders each having an upper hooking portion and a lower abutment portion, each longitudinal girder having a top and a bottom, the auxiliary and additional girders being connectible merely with the upper hooking portion to the longitudinal girder at the top thereof by means of a hooking connection and being connectible with the lower abutment portion to the bottom of the longitudinal girder by means of a hooking connection, the support brackets being part of the auxiliary or additional girders extending between the upper hooking portion and the lower abutment portion.

2. The shelf system according to claim 1, wherein each of the longitudinal and transverse girders has an upper sectional portion and a lower sectional portion, and wherein the hooking portion surrounds in a positively locking manner over the entire width thereof the upper sectional portion of the longitudinal girders and transverse girders, the abutment portion being frictionally secured on the lower sectional portion of the longitudinal girders and transverse girders.

3. The shelf system according to claim 1, wherein the support bracket of each auxiliary or additional girder is offset relative to the hooking portion thereof by the structural height of the auxiliary support elements.

4. The shelf system according to claim 1, wherein the support bracket of each auxiliary or additional girder defines engagement openings which are adapted in size to correspond to the structural height of the auxiliary support elements.

5. The shelf system according to claim 4, wherein the engagement openings are selected from the group consisting of slots, teeth, grooves and holes.

6. The shelf system according to claim 4, wherein the support bracket of the auxiliary or additional girder has the shape of a channel including an outer wall, the outer wall of the channel defining the engagement openings

7. The shelf system according to claim 6, wherein the outer wall of the channel is formed by a double layer of material.

8. The shelf system according to claim 4, wherein the support bracket has an essentially triangular shape with an at least approximately horizontally extending web and an inclined web connected to and forming an acute angle with the horizontal web, the engagement openings being defined in the horizontal web and the inclined web.

9. The shelf system according to claim 1, wherein the hooking portion of each auxiliary or additional girder is cut out in longitudinal direction thereof to form teeth with gaps being defined between the teeth, wherein the width of the gaps is greater than the width of the teeth by a slight engagement play.

10. The shelf system according to claim 1, wherein the hooking portion of each auxiliary or additional girder has two end portions which face away from each other, one of the end portions extending uninterrupted over the entire length of the auxiliary or additional girder, the other end portion being formed by tongues cut out and angularly bent from the auxiliary or additional girder.

11. The shelf system according to claim 10, wherein the tongues are directed downwardly and the uninterrupted end portion is directed upwardly.

12. The shelf system according to claim 2, wherein the support bracket of the auxiliary or additional girder is formed at least partially by the abutment portion thereof.

13. The shelf system according to claim 2, wherein the support bracket of the auxiliary or additional girder extends to the level of the abutment portion.

14. The shelf system according to claim 1, wherein the abutment portion of each auxiliary or additional girder includes clamping pieces which engage in and are locked against rotation in engagement openings defined in the longitudinal girders and transverse girders.

15. The shelf system according to claim 1, wherein the longitudinal girders and transverse girders are selected from the group consisting of L-sections, C-sections, G-sections and U-sections of bent laminated materials.

16. The shelf system according to claim 15, wherein the laminated material is sheet metal.

17. The shelf system according to claim 1, wherein the longitudinal girders and transverse girders are T-sections or I-sections.

18. The shelf system according to claim 1, wherein the longitudinal girder and transverse girder are I-sections.

19. The shelf system according to claim 1, wherein the auxiliary or additional girders extend parallel to the longitudinal direction of the transverse girders and are releasably fastened to the transverse girders, the auxiliary or additional girders each having an upper hooking portion and a lower abutment portion, each transverse girder having a top and a bottom, the auxiliary or additional girders being connectible merely with the upper hooking portion to the transverse girders at the top thereof by means of a hooking connection and being connectible with the lower abutment portion to the bottom of the longitudinal girder by means of a hooking connection, the support brackets being part of the auxiliary or additional girders extending between the upper hooking portion and the lower abutment portion.

* * * * *